US009322140B2

(12) United States Patent
Vanderlinden

(10) Patent No.: US 9,322,140 B2
(45) Date of Patent: Apr. 26, 2016

(54) APPARATUS FOR USE AS PART OF A SURFACE CLEANING VEHICLE AND FOR USE AS PART OF A SANDER-SALTER VEHICLE

(71) Applicant: Roger P. Vanderlinden, Burlington (CA)

(72) Inventor: Roger P. Vanderlinden, Burlington (CA)

( * ) Notice: Subject to any disclaimer, the term of this patent is extended or adjusted under 35 U.S.C. 154(b) by 25 days.

(21) Appl. No.: 13/646,646

(22) Filed: Oct. 5, 2012

(65) Prior Publication Data

US 2015/0026913 A1 Jan. 29, 2015

(51) Int. Cl.
*E01H 1/08* (2006.01)
*E01H 10/00* (2006.01)

(52) U.S. Cl.
CPC ..... *E01H 1/0854* (2013.01); *E01H 1/0836* (2013.01); *E01H 10/007* (2013.01)

(58) Field of Classification Search
CPC ... E01H 1/0854; E01H 1/0836; E01H 1/0827; E01H 10/007
USPC ..... 15/340.1, 346, 348, 320
See application file for complete search history.

(56) References Cited

U.S. PATENT DOCUMENTS 4,561,145 A * 12/1985 Latham ..... 15/346
6,122,797 A * 9/2000 Vanderlinden ..... 15/346
6,195,837 B1 * 3/2001 Vanderlinden ..... 15/348

* cited by examiner

*Primary Examiner* — Dung Van Nguyen

(57) ABSTRACT

An apparatus comprises a main hopper having a surface cleaning configuration and a sander-salter configuration. In the surface cleaning configuration, the main hopper has a debris-laden airflow ingress, an airflow egress, and a debris dumping egress, and is sealed to the ambient surroundings other than the debris-laden airflow ingress and the airflow egress. In the sander-salter configuration, the main hopper has a sander and salt receiving ingress and a sand and salt egress. In use, in the surface cleaning configuration, the debris-laden air enters the main hopper through the debris-laden airflow ingress, air exits the main hopper through the airflow egress, and the debris exits the main hopper through the debris dumping egress. In use, in the sander-salter configuration, the sand and salt enter the main hopper through the sander and salt receiving ingress, and the sand and salt exit the main hopper through the sand and salt egress.

28 Claims, 14 Drawing Sheets

APPARATUS FOR USE AS PART OF A SURFACE CLEANING VEHICLE AND FOR USE AS PART OF A SANDER-SALTER VEHICLE

RELATED APPLICATIONS

This application is a non-provisional application claiming priority from U.S. Provisional Patent Application Ser. No. 61/543,754 filed on Oct. 5, 2011, which is herein incorporated by reference.

FIELD OF THE INVENTION

The present invention relates to surface cleaning vehicles, and more particularly to street sweeping vehicles and sander-salter vehicles.

Prior art surface cleaning vehicles, such as surface cleaning vehicles and sidewalk cleaning vehicles, and the like, are used during summer months to clean streets, sidewalks, parking lots and the link. Some surface cleaning vehicles, such as those that dump debris out the top of the main hopper, can be converted to a salter-sander type of vehicle by adding on a sand and salter spreader apparatus to the rear of the main hopper. An open top container feeds sand and salt to the sand and salt spreading apparatus. The main hopper feeds the sand and salt to the open top container by dumping rearwardly, at least partially.

There are a number of problems associated with this type of prior art surface cleaning vehicles that is converted to a salter-sander type of vehicle. First, the sand and salter spreader apparatus and the open top container must be stored during summer months. Secondly, it is very common to dump sand and salt such that it misses the open top container. Further, since the sand and salt can suddenly "let go" during the dumping process, it is common to overflow and/or overshoot the open top container. This problem is exacerbated by the fact that the capacity of the main hopper of the surface cleaning vehicle is significantly greater than the capacity of the open top container. It also can be readily envisioned that the process of dumping sand and salt from the main hopper to the open top container is not continuous, but intermittent, which slows down the overall salting and sanding operation considerably and significantly. Also, the opening the top of the main hopper frequently permits snow and other forms of water into the main hopper, which can cause the salt in the main hopper to clump. Further, the sand and salt spreader apparatus makes the overall vehicle significantly longer, thereby making the vehicle more difficult to maneuver.

It is also common for an independent vehicle, such as a tractor, to be used to tow or carry a hopper, and the other related surface cleaning equipment in summer months, and tow or carry a sander/salter hopper and apparatus during winter months. This is undesirable for various reasons, including the significant extra capital cost of having sets of equipment for both seasons, and the storage of equipment, including large hoppers, during the offseason. Further, significant time needs to be spent mounting and unmounting equipment each season, which may need to be done in an extreme hurry, for instance, immediately after the last winter storm.

It is an object of the present invention to provide an apparatus, wherein it is not necessary to store the sand and salter spreader apparatus and the open top container during summer months.

It is an object of the present invention to provide an apparatus, wherein there is no dumping of the sand and salt to the secondary sand and salt attachment such that it misses the open top container.

It is an object of the present invention to provide an apparatus, wherein the process of feeding sand and salt from the main hopper to the sand and salt spreading apparatus can be continuous.

It is an object of the present invention to provide an apparatus, wherein the process of transferring sand and salt from the main hopper to the sand and salt spreading apparatus does not slow down the overall salting and sanding operation significantly.

It is an object of the present invention to provide an apparatus, wherein the process of transferring sand and salt from the main hopper to the sand and salt spreading apparatus does not require the top of the main hopper to be opened.

It is an object of the present invention to provide an apparatus, wherein the capital cost of equipment is significantly reduced.

It is an object of the present invention to provide an apparatus, wherein the storage of equipment during the off-season is virtually unnecessary.

It is an object of the present invention to provide an apparatus, wherein the time needed to be spent mounting and unmounting equipment each season is minimized.

It is an object of the present invention to provide an apparatus having a surface cleaning configuration and a sander-salter configuration.

It is an object of the present invention to provide an apparatus having a surface cleaning configuration and a sander-salter configuration, wherein the main hopper has substantially the same capacity in both configurations.

It is an object of the present invention to provide an apparatus having a surface cleaning configuration and a sander-salter configuration, wherein the main hopper is designed to carry the load of debris in the surface cleaning configuration and to carry the load of sand and/or in the sander-salter configuration.

It is an object of the present invention to provide an apparatus, wherein the main hopper does not dump salt and/or sand to the sand and salt egress.

SUMMARY OF THE INVENTION

In accordance with one aspect of the present invention there is disclosed a novel apparatus comprising a main hopper having a surface cleaning configuration and a sander-salter configuration; wherein, in the surface cleaning configuration, the main hopper has a debris-laden airflow ingress, an airflow egress, and a debris dumping egress, and is substantially sealed to the ambient surroundings other than the debris-laden airflow ingress and the airflow egress; wherein, in the sander-salter configuration, the main hopper has a sander and salt receiving ingress and a sand and salt egress; wherein, in use, and when the main hopper is in the surface cleaning configuration, substantially all debris-laden air enters the main hopper through the debris-laden airflow ingress, substantially all air exits the main hopper through the airflow egress, and substantially all debris exits the main hopper through the debris dumping egress; and wherein, in use, and when the main hopper is in the sander-salter configuration, substantially all sand and salt enter the main hopper through the sander and salt receiving ingress, and substantially all sand and salt exit the main hopper through the sand and salt egress.

In accordance with another aspect of the present invention there is disclosed a novel surface cleaning vehicle comprising a main vehicle; a main hopper connected to the main vehicle; a main fan having an air inlet and an air outlet; a debris pick-up head having an air inlet and an air outlet; wherein the air inlet of the main fan is connected in sealed relation to the airflow egress of the main hopper, the air outlet of the main fan is connected in sealed relation to the air inlet of the pick-up head, and the air outlet of the pick-up head is connected in sealed relation to the debris-laden airflow ingress of the main hopper; wherein the main hopper has a surface cleaning configuration and a sander-salter configuration; wherein, in the surface cleaning configuration, the main hopper has a debris-laden airflow ingress, an airflow egress, and a debris dumping egress, and is substantially sealed to the ambient surroundings other than the debris-laden airflow ingress and the airflow egress; and wherein, in the sander-salter configuration, the main hopper has a sander and salt receiving ingress and a sand and salt egress; wherein, in use, and when the main hopper is in the surface cleaning configuration, substantially all debris-laden air enters the main hopper through the debris-laden airflow ingress, substantially all air exits the main hopper through the airflow egress, and substantially all debris exits the main hopper through the debris dumping egress; and wherein, in use, and when the main hopper is in the sander-salter configuration, substantially all sand and salt enter the main hopper through the sander and salt receiving ingress, and substantially all sand and salt exit the main hopper through the sand and salt egress.

In accordance with another aspect of the present invention there is disclosed a novel sander salter vehicle comprising a main vehicle; a sander-salter dispersing mechanism connected in trailing relation to the main vehicle; a main hopper connected to the main vehicle; a main fan having an air inlet and an air outlet; a debris pick-up head having an air inlet and an air outlet; wherein the air inlet of the main fan is connected in sealed relation to the airflow egress of the main hopper, the air outlet of the main fan is connected in sealed relation to the air inlet of the pick-up head, and the air outlet of the pick-up head is connected in sealed relation to the debris-laden airflow ingress of the main hopper; wherein the main hopper has a surface cleaning configuration and a sander-salter configuration; wherein, in the surface cleaning configuration, the main hopper has a debris-laden airflow ingress, an airflow egress, and a debris dumping egress, and is substantially sealed to the ambient surroundings other than the debris-laden airflow ingress and the airflow egress; wherein, in the sander-salter configuration, the main hopper has a sander and salt receiving ingress and a sand and salt egress; wherein the sander-salter dispersing mechanism disposed exteriorly to the main hopper and in sand and salt receiving relation with respect to the sand and salt egress; wherein, in use, and when the main hopper is in the surface cleaning configuration, substantially all debris-laden air enters the main hopper through the debris-laden airflow ingress, substantially all air exits the main hopper through the airflow egress, and substantially all debris exits the main hopper through the debris dumping egress; and wherein, in use, and when the main hopper is in the sander-salter configuration, substantially all sand and salt enter the main hopper through the sander and salt receiving ingress, and substantially all sand and salt exit the main hopper through the sand and salt egress.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features The novel features which are believed to be characteristic of the apparatus for use as part of a surface cleaning vehicle and for use as part of a salter-sander vehicle according to the present invention, as to its structure, organization, use and method of operation, together with further objectives and advantages thereof, will be better understood from the following drawings in which the presently preferred embodiments of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 3:
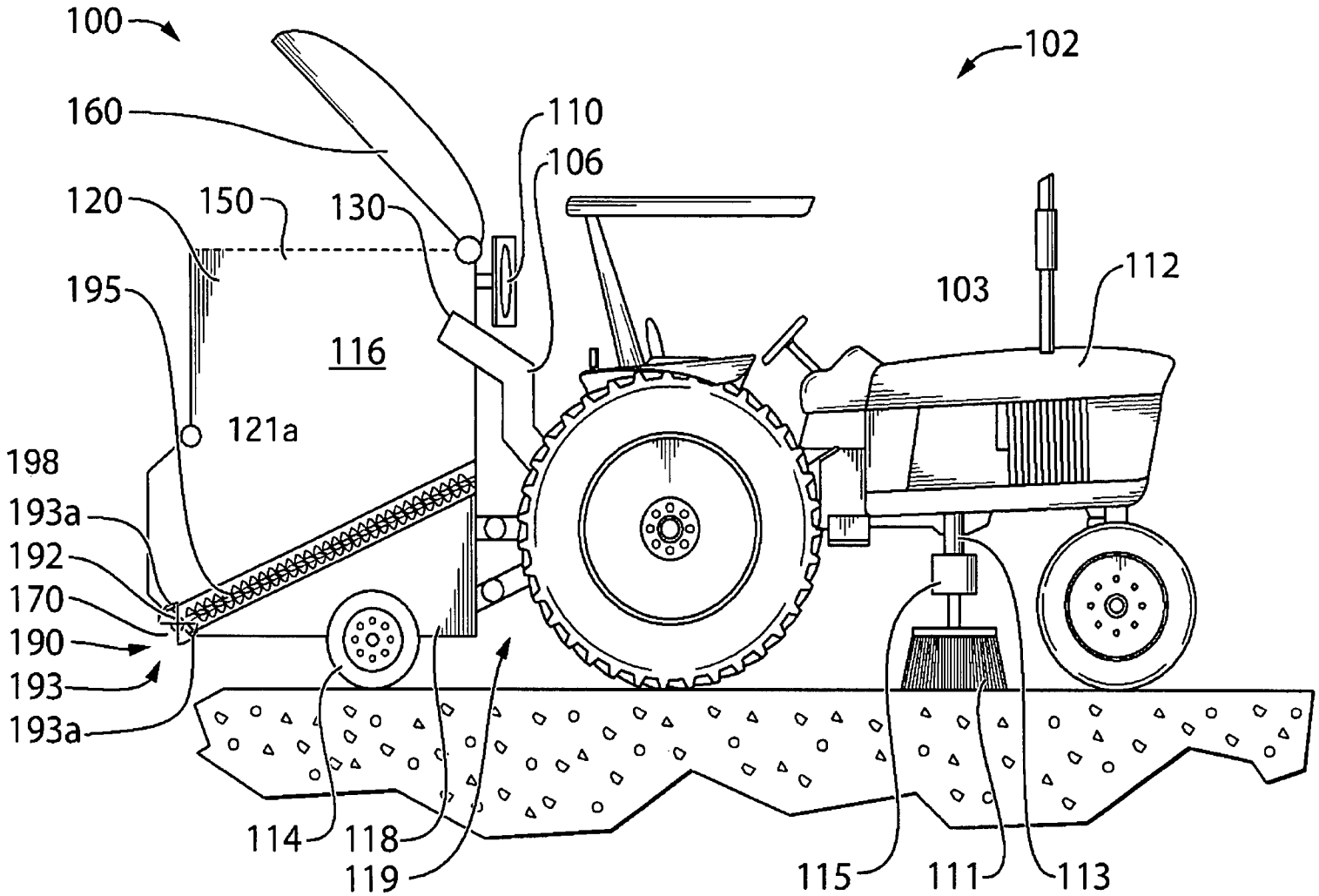
FIG. 3 is a side elevational view of the first preferred embodiment of the apparatus of FIG. 1, in a salter/sander configuration and with the top dumping door open.
Figure 4:
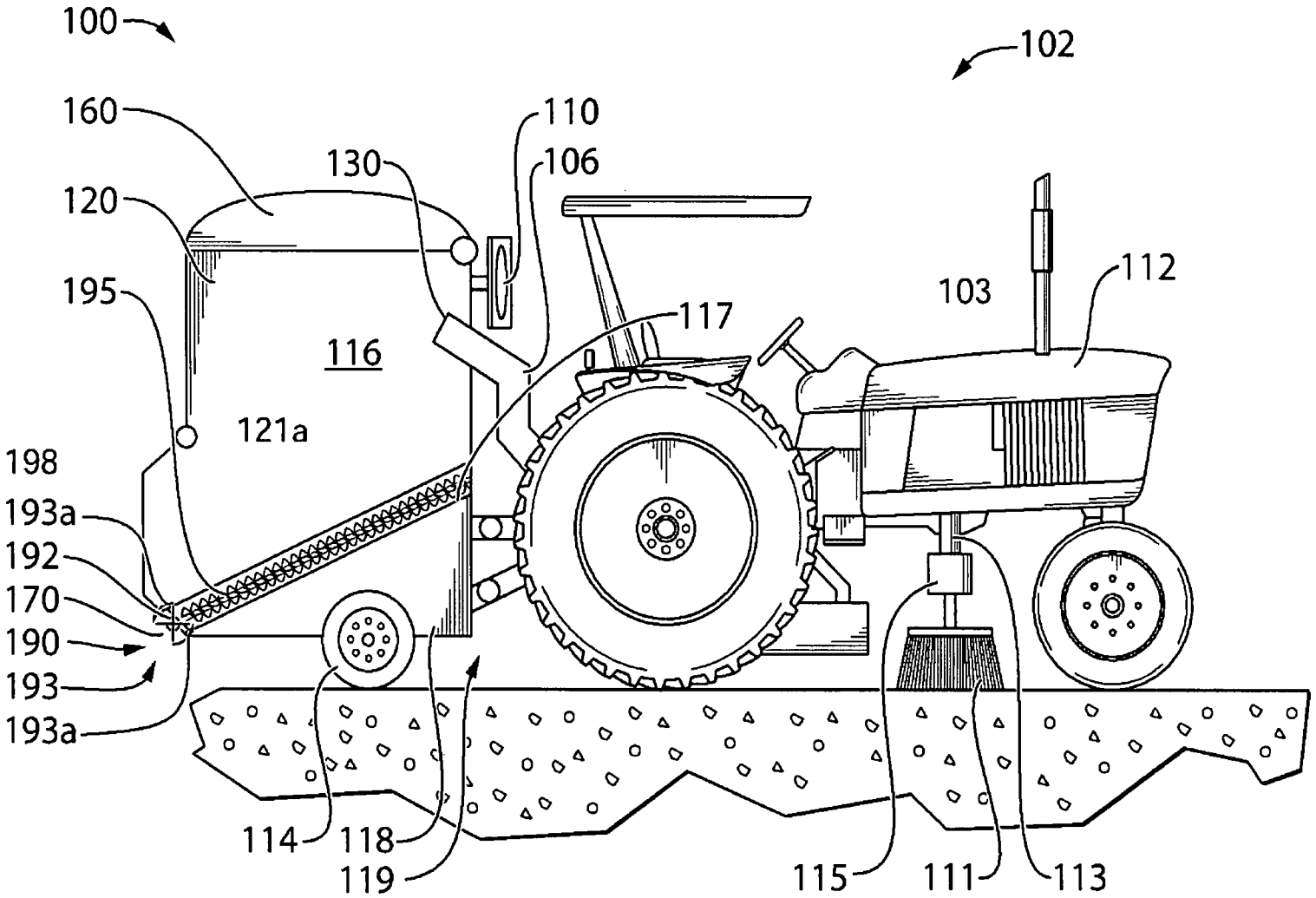
FIG. 4 is a side elevational view of the first preferred embodiment of the apparatus of FIG. 1, in a salter/sander configuration and with the top dumping door closed.
Figure 5:
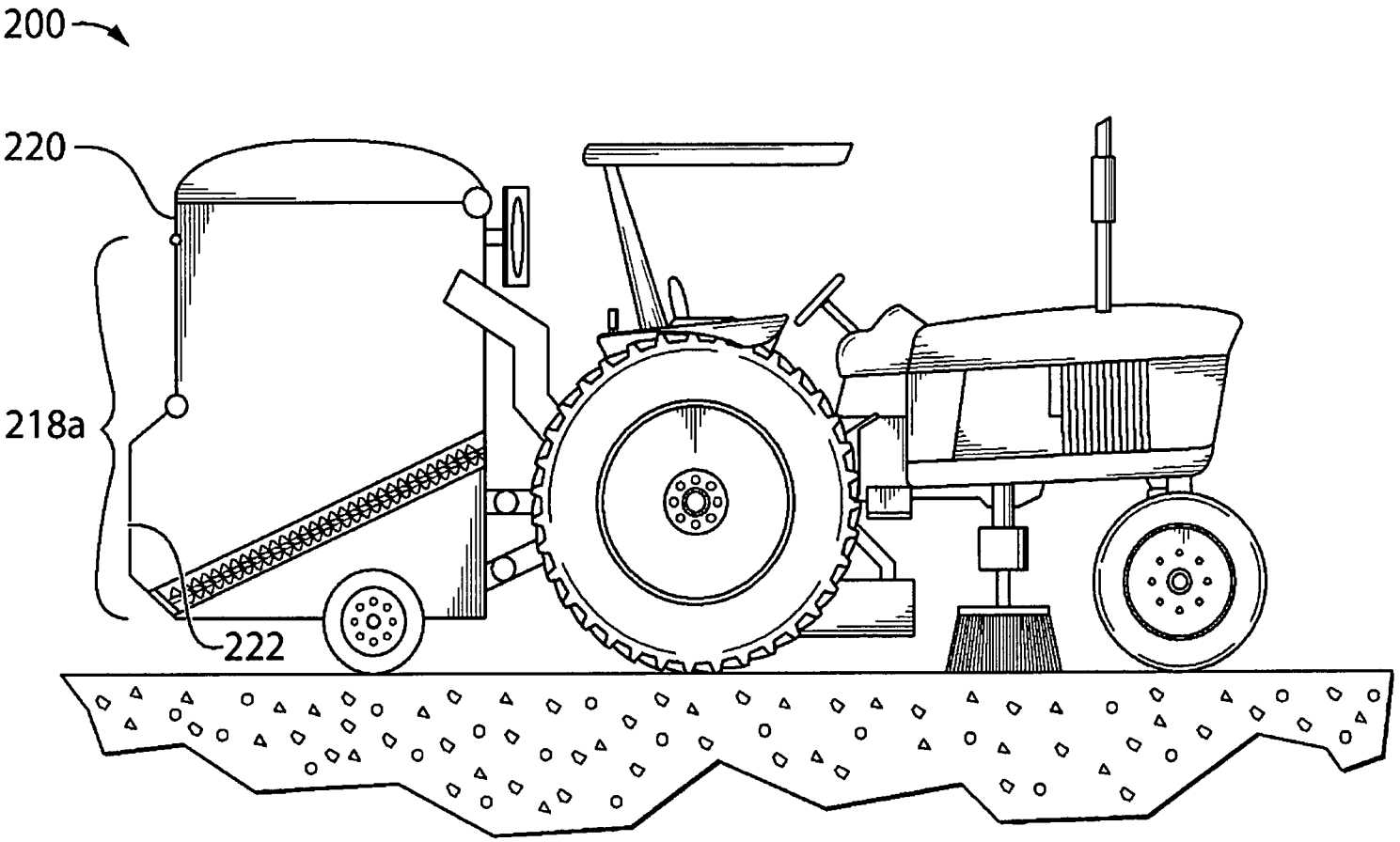
FIG. 5 is a side elevational view of the second preferred embodiment of the apparatus according to the present invention, in a sweeping configuration wherein the removable and replaceable back panel is in place for the sweeping configuration.
Figure 6:
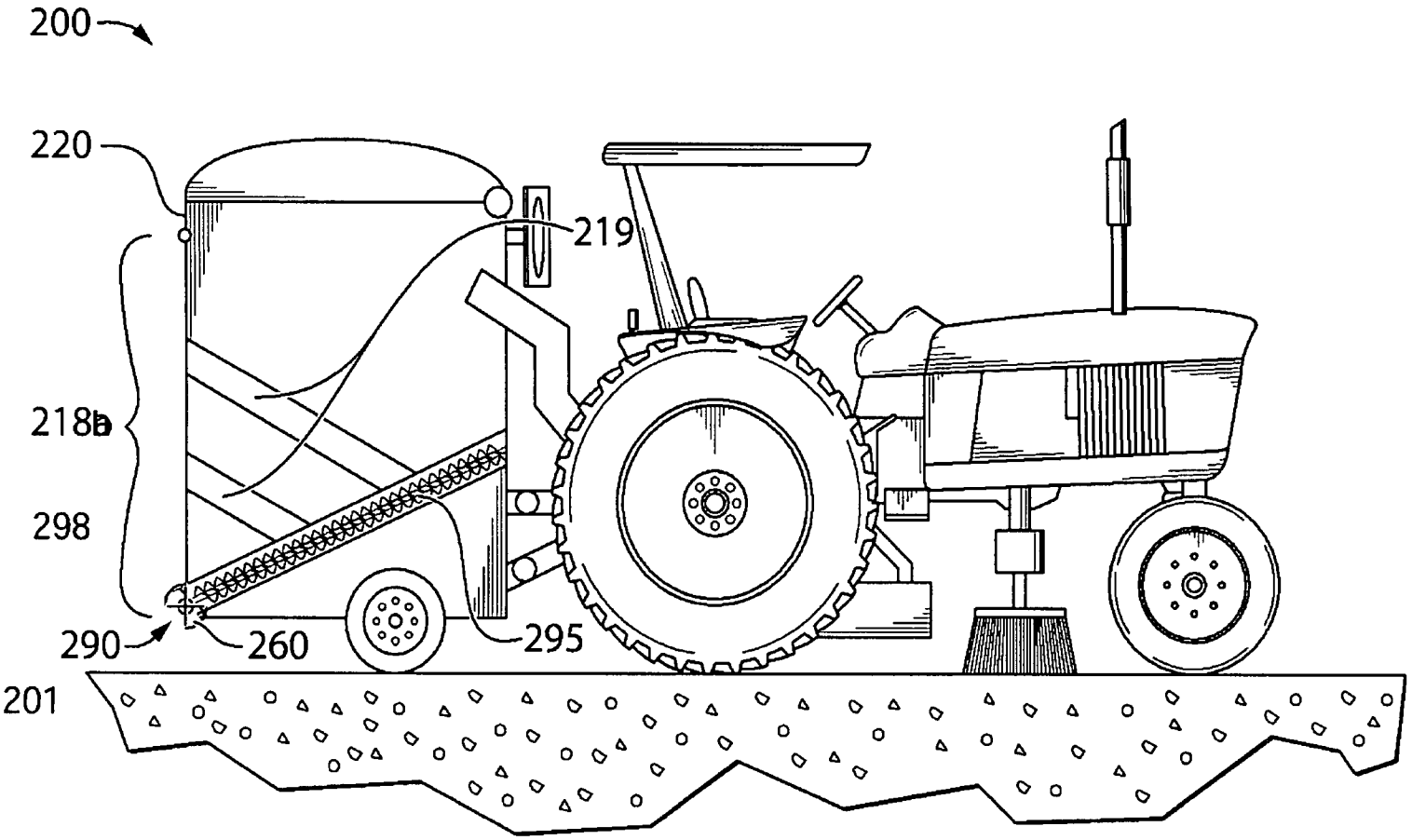
FIG. 6 is a side elevational view of the second preferred embodiment of the apparatus of FIG. 5, in a salter/sander configuration wherein the removable and replaceable back panel is in place for the salter/sander configuration.
Figure 12:
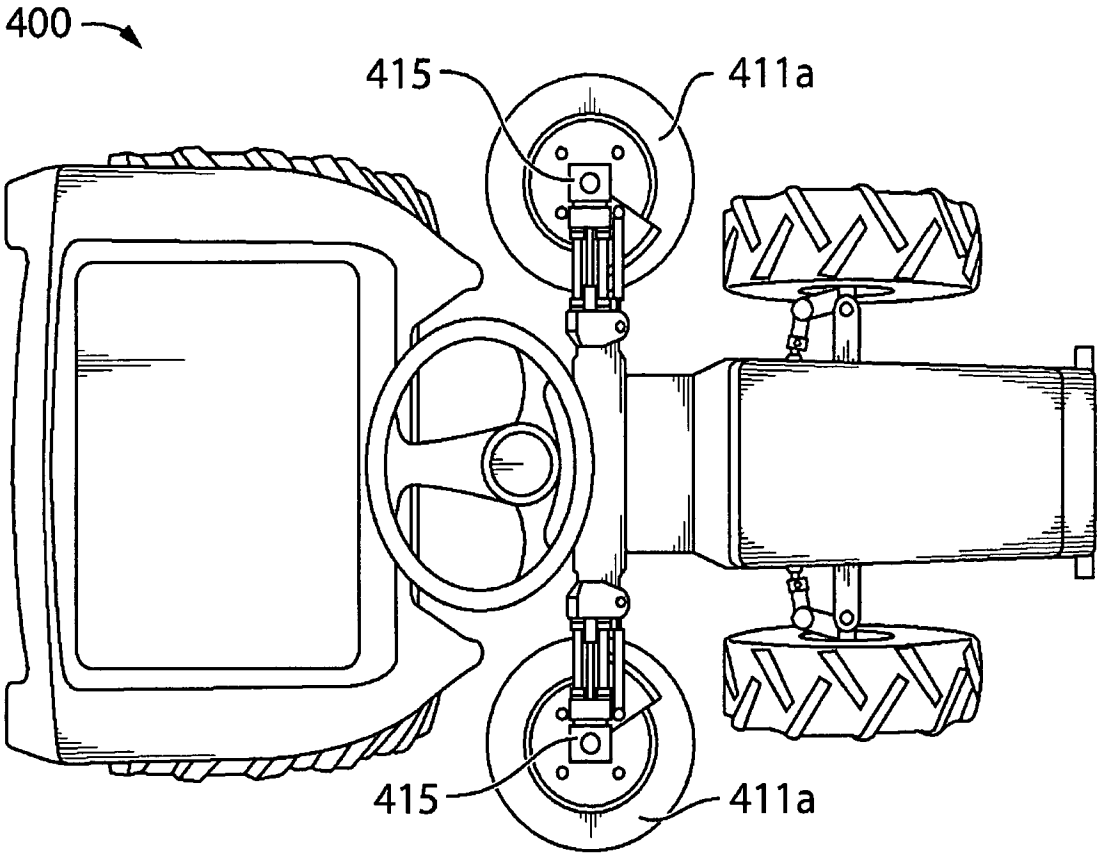
FIG. 12 is a top plan view of the fourth preferred embodiment of the apparatus according to the present invention, with gutter brooms attached to the gutter broom arms.
Figure 13:
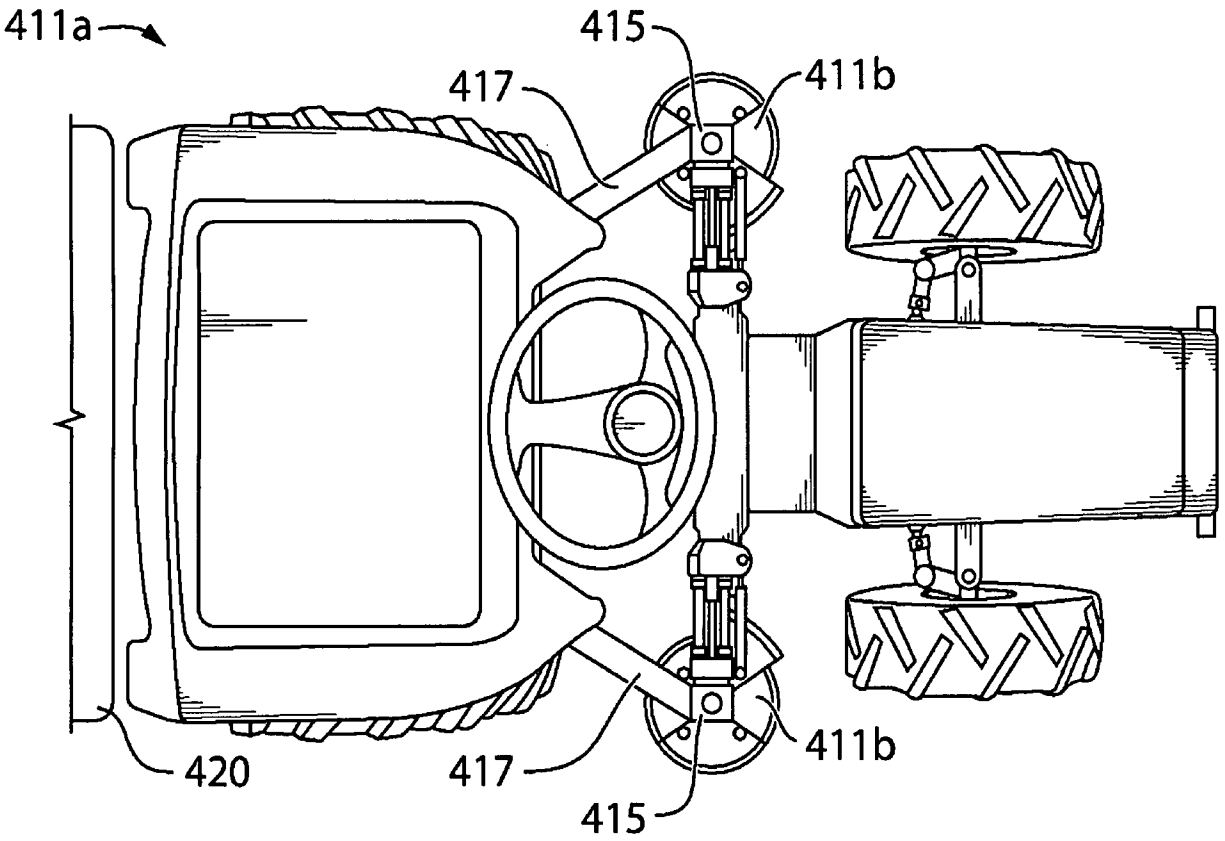
FIG. 13 is top plan view of the fourth preferred embodiment of the apparatus of FIG. 12, with rotatable sand and salt spreaders attached to the gutter broom arms; and, FIG. 14 is top plan view of the fifth preferred embodiment of the apparatus of FIG. 12, with a lawn mower apparatus attached to the gutter broom arms.
Figure 14:
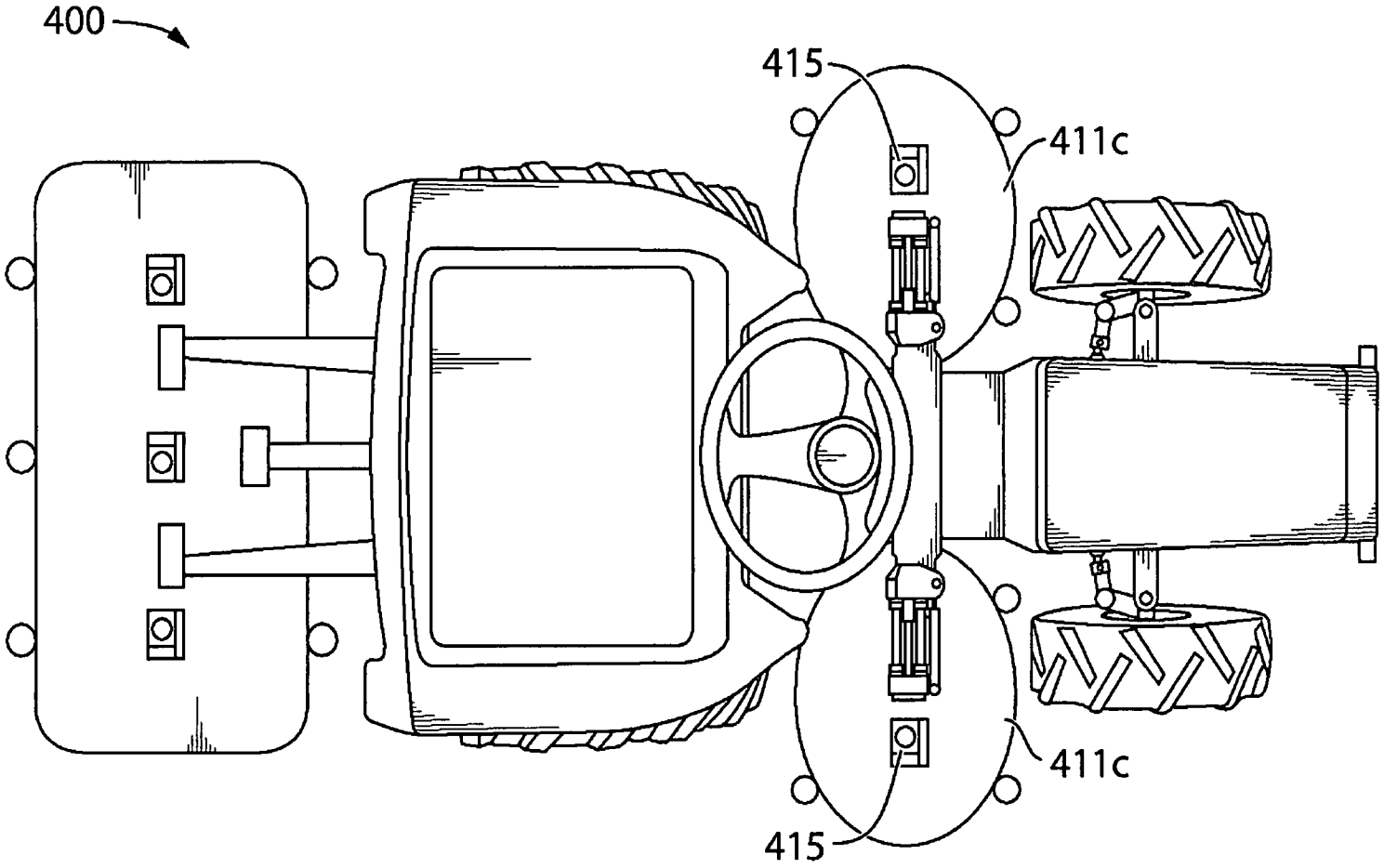

Referring to FIGS. 1 through 14 of the drawings, it will be noted that FIGS. 1 through 4 illustrate a first preferred embodiment of the apparatus according to the present invention, FIGS. 5 and 6 illustrate a second preferred embodiment of the apparatus according to the present invention, FIGS. 7 through 11 illustrate a third preferred embodiment of the apparatus according to the present invention, and FIGS. 12, 13 and 14 illustrate a fourth preferred embodiment of the apparatus according to the present invention.

Reference will now be made to FIGS. 1 through 4, which show a first preferred embodiment of the apparatus according to the present invention, as indicated by the general reference numeral 100. The apparatus 100 is for use as part of a surface cleaning vehicle 102 and for use as part of a salter-sander vehicle 102. The salter-sander vehicle 102 is, as shown, a vacuum type surface cleaning vehicle, or alternatively can be a re-circulating air type surface cleaning vehicle. In either case, the vehicle 102 includes a main vehicle 103, and has a pick-up head 104, a debris-laden-air delivery hose 106, a main hopper 120 having a surface cleaning configuration and a salter-sander configuration, a filter 108, and a main fan 110 that suctions air from the pick-up head 104 through the main hopper 120 and the filter 108, and to the ambient surroundings.

As illustrated, the vehicle is a tractor 112 that carries or tows the apparatus 100 substantially in trailing relation. Alternatively, the vehicle might be an integrated truck unit, or might be any other type of suitable configuration. The tractor 112 has a pair of gutter brooms 111 operatively mounted on the gutter broom arms 113 such that the rotatable gutter brooms 111 are selectively rotated by the hydraulic motors 115 when the apparatus 100 is in its surface cleaning configuration. The tractor 112 also has the pick-up head 104 operatively mounted between the front and rear wheels of the tractor 112, and connected in debris delivery relation to the main hopper 120 by a debris-laden-air delivery hose 106.

It should be understood that the term "sand and salt" means sand and salt mixed together, salt separately and sand separately, as may be required.

The first preferred embodiment of the apparatus 100 basically comprises a main hopper 120, a debris-laden airflow ingress 130, means 139 for selectively interfacing the debris-laden airflow ingress 130 in sealed relation with the debris-laden-air delivery hose 106, an airflow egress 144, a debris dumping egress 148, a sand and salt receiving ingress 150, means 160 for selectively closing off the sand and salt receiving ingress 150, a sand and salt egress 170, means 180 for selectively closing off the sand and salt egress 170, sander-salter dispersing mechanism 190 for dispersing the sand and salt from the sand and salt egress 170, and a sand and salt transfer apparatus 195. It should be noted that each of the debris-laden airflow ingress 130, the airflow egress 144, the debris dumping egress 148, the sand and salt receiving ingress 150, and the sand and salt egress 170, could be a single ingress/egress or multiple ingresses/egresses, as is suitable.

There is a mounting apparatus 119 comprising a three point hitch for mounting the apparatus 100 in trailing relation to the tractor 112. The tow hitch of the tractor 112 could also be used.

Figure 1:
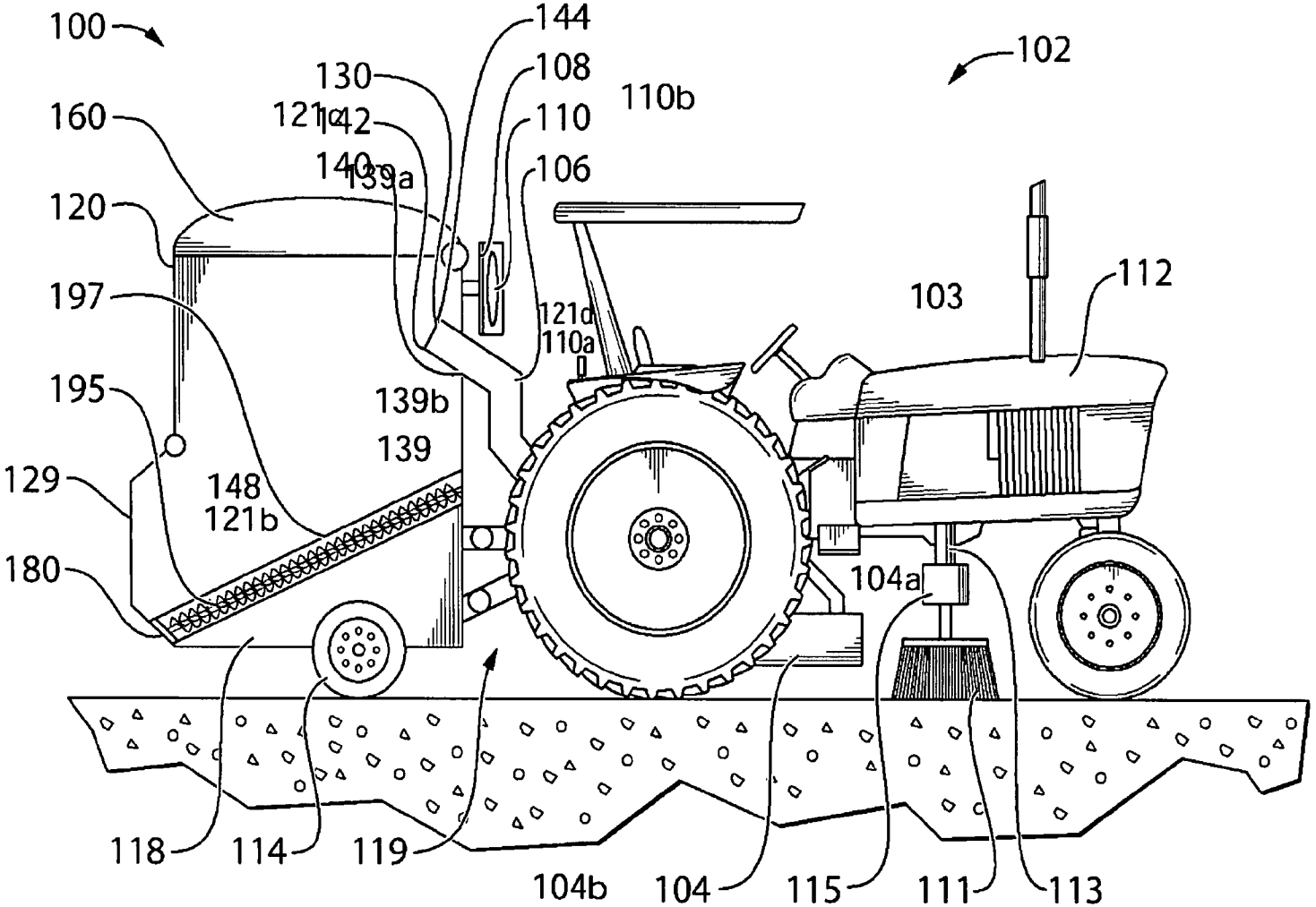
FIG. 1 is a side elevational view of the first preferred embodiment of the apparatus according to the present invention, in a sweeping configuration and with the top dumping door closed.
Figure 2:
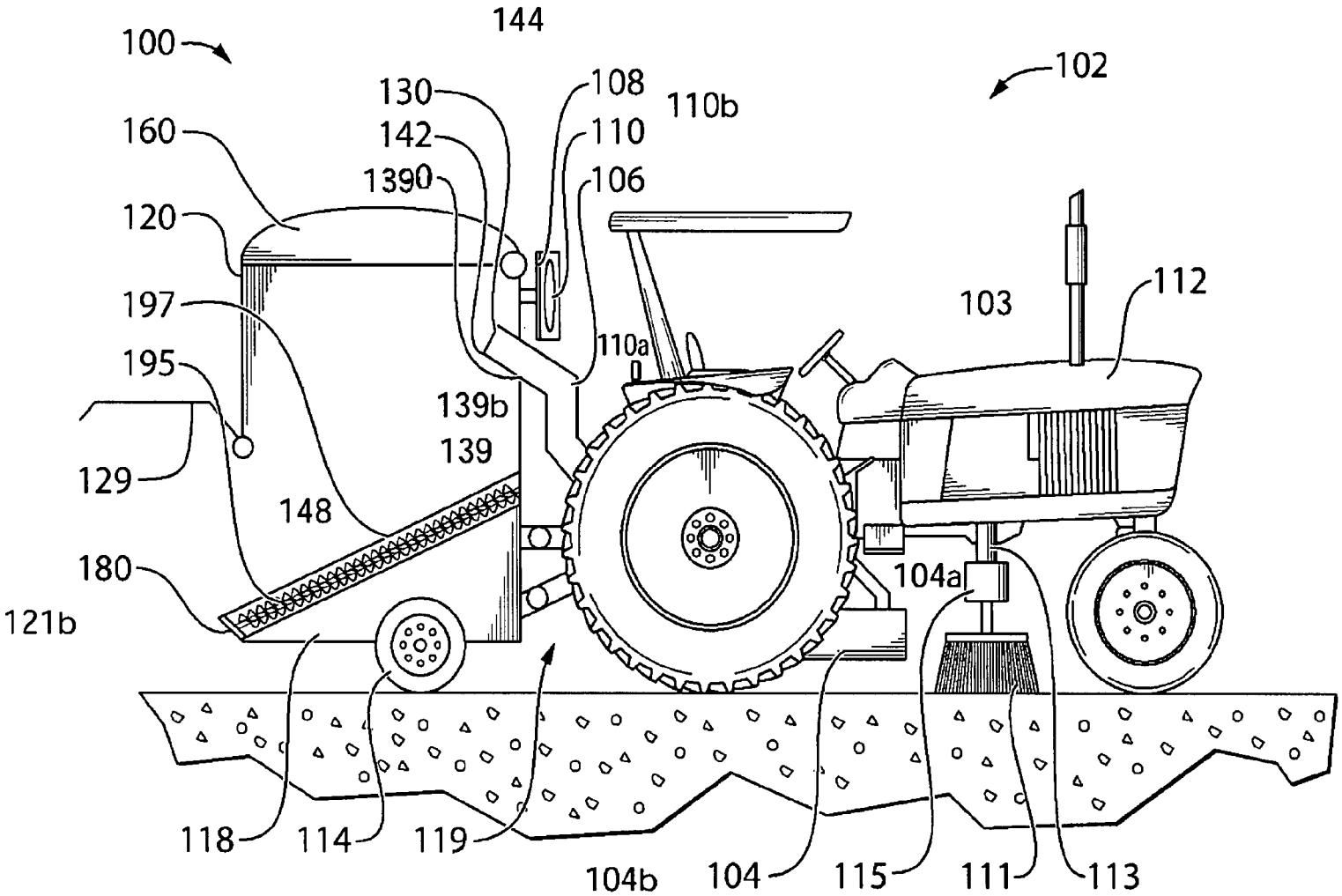
FIG. 2 is a side elevational view of the first preferred embodiment of the apparatus of FIG. 1, in a sweeping configuration and with the top dumping door open.

The apparatus 100 has two configurations, namely a surface cleaning configuration, as shown in FIGS. 1 and 2, and a salter-sander configuration, as shown in FIGS. 3 and 4. In the surface cleaning configuration, the main hopper 120 has the debris-laden airflow ingress 130, the airflow egress 144, and the debris dumping egress 148. The debris-laden airflow ingress 130 is in fluid communication with the debris-laden-air delivery hose 106 that is connected in fluid communication with the pick-up head 104. In the surface cleaning configuration, the main hopper 120 is substantially sealed to the ambient surroundings, other than the debris-laden airflow ingress 130 and the airflow egress 144, which may be in fluid communication with the ambient surroundings, typically intermittently, through the pick-up head 104. The substantially hollow interior 116 of the main hopper 120 experiences reduced air pressure during use, in the surface cleaning configuration.

In the sander-salter configuration, the main hopper 120 directly feeds sand and/or salt to the sand and salt egress 170 on a substantially continuous basis. More specifically, the main hopper 120 comprises a single unitary main cavity, namely the substantially hollow interior 116, for receiving and retaining debris in the surface cleaning configuration and for retaining sand and salt in the sander-salter configuration. In the surface cleaning configuration, the single unitary main cavity 116 directly feeds sand and/or salt to the sand and salt egress 170 on a substantially continuous basis. Further, in the surface cleaning configuration, the single unitary main cavity 116 is in open relation with respect to the sand and salt egress 170.

Further, the sand and salt receiving ingress 150 and the sand and salt receiving egress 170 are sealed off to the ambient surroundings such that air flow is not permitted into the main hopper 120, thereby not destroying the suctioning effect of the pick-up head 104 as caused by the main fan 110, and not permitting dust or fine particulate matter from the debris laden air within the main hopper 120 to escape to the ambient surroundings. Preferably, the sand and salt transfer apparatus 195 is either removed or covered such that debris is not introduced to the sand and salt transfer apparatus 195. Further, the sander-salter dispersing mechanism 190 for dispersing the sand and salt is preferably removed from the apparatus 100.

In the salter-sander configuration, the main hopper 120 has the sand and salt receiving ingress 150 and the sand and salt egress 170. The sand and salt receiving ingress 150 is either open or selectively openable in order to permit the ready depositing of sand and salt into the main hopper 120. Also, the sand and salt egress 170 is either open or selectively openable in order to permit the ready delivery of sand and salt 121*a* to the sander-salter dispersing mechanism 190. Further, the sander-salter dispersing mechanism 190 is mounted on the main hopper 120, and is therefore carried by the main hopper 120, adjacent the sand and salt egress 170 so as to receive sand and salt from the sand and salt egress 170. Further, the sander-salter dispersing mechanism 190 is disposed exteriorly to the main hopper 120 and in sand and salt receiving relation with respect to the sand and salt egress 170.

The apparatus 100 comprises the main hopper 120 having a substantially hollow interior 116 for alternatingly containing sand and salt 121*a* in the salter-sander configuration, and containing debris 121*b* from the flow of debris-laden air in the surface cleaning configuration. The main hopper 120 can have a supporting frame (not shown), as required, in order to support the weight of debris in the main hopper 120 in the surface cleaning configuration and support the weight of sand and salt in the main hopper 120 in the salter-sander configuration. There is also a plurality of wheels 114 mounted in weight bearing relation on the main hopper, more specifically, mounted beneath the main hopper 120, for supporting the apparatus 100 in rolling relation on the surface being cleaned 101.

In the first preferred embodiment, as illustrated, the main hopper has a rearwardly slanted floor portion 117 that leads downwardly to the sand and salt egress 170 at its lower end. The rearwardly slanted floor portion 117 helps ensure that the sand and salt slide to the sand and salt egress 170. There is also a water tank 118 disposed beneath the floor slanted floor portion 117. The water from the water tank 118 can used for dust control during the sweeping operation.

The first preferred embodiment apparatus 100 further comprises the air fan 110 in the main hopper 120, disposed adjacent the top of the main hopper 120, for suctioning air from the main hopper 120, and a debris filtering screen 108 in the main hopper 120, disposed just before the air fan 110. The air fan 110 and the debris filtering screen 108 are part of the vacuum system or recirculating air system of the surface cleaning vehicle 102.

There is a debris-laden airflow ingress 130 in the main hopper 120 for receiving a flow of debris-laden air into the main hopper 120 when the main hopper 120 is in the surface cleaning configuration. Preferably, but not necessarily, the debris-laden airflow ingress 130 is adjacent the top of the main hopper 120; however, the debris-laden airflow ingress 130 may be lower than the top of the main hopper 120 and the debris can be delivered upwardly by the flow of the debris-laden air from the debris-laden airflow ingress 130.

There is also means 139 for selectively interfacing the debris-laden airflow ingress 130 in sealed relation with a debris-laden-air delivery hose 106 when the main hopper is in the surface cleaning configuration. In the first preferred embodiment, as illustrated, the means 139 for selectively interfacing the debris-laden airflow ingress 130 in sealed relation with a debris-laden-air delivery hose 106 comprises an outwardly projecting annular rim 139*a* and a tightenable metal strap 139*b*, as is well known in the industry.

The sand and salt receiving ingress 150 is disposed in the main hopper for receiving a sand and salt into the main hopper 102 when the main hopper 120 is in the salter-sander configuration. The sand and salt receiving ingress 150 is preferably adjacent the top of the main hopper 120, and in the first preferred embodiment, as illustrated, the sand and salt receiving ingress 150 comprises a top opening in the main hopper 120.

There is also means 160 for selectively closing off the sand and salt receiving ingress 150 in sealed relation with respect to the ambient surroundings when the apparatus 100 is in the surface cleaning configuration. In the first preferred embodiment, as illustrated, the means 160 for selectively closing off the sand and salt receiving ingress 150 comprises the top hopper lid 160 of the main hopper 120 mounted in hinged relation over the top opening such that it can be opened to permit the ingress of debris into the main hopper 120, and can be closed during the operation of the apparatus 100 in the salter-sander configuration, and can be closed in sealed relation to the ambient surroundings during the operation of the apparatus 100 in the surface cleaning configuration.

The main hopper 120 also has a rear vertically oriented dumping door 129. In the sweeping configuration, the dumping door 129 is closed (in sealed relation) in FIG. 1 and is open in FIG. 2 to allow for dumping of the debris within the main hopper 120. In the salter/sander configuration, the dumping door 129 is closed, and may be closed in sealed relation if necessary.

There is also a sand and salt egress 170 in the main hopper 120 for permitting the egress of sand and salt from the substantially hollow interior 116 of the main hopper to the sand and salt transfer apparatus 195 when the apparatus 100 is in the salter-sander configuration. There is a means 180 for selectively closing off the sand and salt egress 170 in sealed relation with respect to the ambient surroundings when the main hopper 120 is in the surface cleaning configuration. In the first preferred embodiment, as illustrated, the means 180 for selectively closing off the sand and salt egress 170 in sealed relation with respect to the ambient surroundings comprises a removable and replaceable egress cover, such as a metal cover with a suitable gasket.

In the event that the sand and salt receiving ingress 150 is the top opening of the main hopper 120, the means 160 for selectively closing off the sand and salt ingress 150 in sealed relation with respect to the ambient surroundings would comprise the selectively openable and closable top hopper lid 160.

The apparatus 100 further comprises a sand and salt transfer apparatus 195 mounted in removable and replaceable relation on the main hopper 120 for moving sand and salt in the main hopper 120 to the sand and salt egress 170. The sand and salt transfer apparatus 195 comprises an auger apparatus that is preferably removable and replaceable such that it is installed in the salter-sander configuration and is removed in the surface cleaning configuration.

The first preferred embodiment apparatus 100 further comprises a removable and replaceable transfer apparatus cover 197 that is mountable in sealed relation over the sand and salt transfer apparatus 195. Alternatively, the egress cover also covers the sand and salt transfer apparatus 195.

The sander-salter dispersing mechanism 190 includes a rotatable delivery member 192 housed in sealed relation within a housing 193 that comprises a pair of arcuate members 193*a*. Any suitable mechanism 190 for dispersing the sand and salt can be used.

Optionally, there is also a removable and replaceable sand and salt agitator 198, which is typically a grinder, disposed at the sand and salt egress 170, and mounted within the main hopper 120 such that said sand and salt agitator 198 is carried by the hopper, for selectively grinding clumps of sand and salt within the main hopper 120, in the event that the salt forms into clumps that typically will not move to the sand and salt egress 170.

In use, and when the main hopper 120 is in the surface cleaning configuration, substantially all debris-laden air 121*c* enters the main hopper 120 through the debris-laden airflow ingress 130, substantially all air 121*d* exits the main hopper 120 through the airflow egress 144, and substantially all debris 121*b* exits the main hopper 120 through the debris dumping egress 148. Further, in use, when the main hopper 120 is in the sander-salter configuration, substantially all sand and salt 121*a* enter the main hopper 120 through the sander and salt receiving ingress 150, and substantially all sand and salt 121*a* exit the main hopper 120 through the sand and salt egress 170. In the sander-salter configuration, the main hopper 120 disperses sand and/or salt 121*a* directly to the surface being maintained 101.

In another aspect, the present invention is a surface cleaning vehicle comprising the main vehicle 103, the main hopper 120 connected in trailing relation to the main vehicle 103. A main fan 110 has an air inlet 110*a* and an air outlet 110*b*. A debris pick-up head 104 has an air inlet 104*a* and an air outlet 104*b*. The air inlet 110*a* of the main fan 110 is connected in sealed relation to the airflow egress 144 of the main hopper 120, the air outlet 110*b* of the main fan 120 is connected in sealed relation to the air inlet 104*a* of the pick-up head 104, and the air outlet 104*b* of the pick-up head 104 is connected in sealed relation to the debris-laden airflow ingress 130 of the main hopper 120.

The main hopper 120 has a surface cleaning configuration and a sander-salter configuration, which have been discussed above in detail, and with respect to the present invention in use.

In another aspect, the present invention is a sander-salter vehicle comprising the main vehicle 103, the sander-salter dispersing mechanism 190 connected in trailing relation to the main vehicle 103, and the main hopper 120 connected in trailing relation to the main vehicle 103. A main fan 110 has an air inlet 110*a* and an air outlet 110*b*. A debris pick-up head 104 has an air inlet 104*a* and an air outlet 104*b*. The air inlet 110*a* of the main fan 110 is connected in sealed relation to the airflow egress 144 of the main hopper 120, the air outlet 110*b* of the main fan 120 is connected in sealed relation to the air inlet 104*a* of the pick-up head 104, and the air outlet 104*b* of the pick-up head 104 is connected in sealed relation to the debris-laden airflow ingress 130 of the main hopper 120.

The main hopper 120 has a surface cleaning configuration and a sander-salter configuration, which have been discussed above in detail, and with respect to the present invention in use.

Reference will now be made to FIGS. 5 and 6, which show a second preferred embodiment of the apparatus according to the present invention, as indicated by the general reference numeral 200. The second preferred embodiment apparatus 200 is similar to the first preferred embodiment apparatus 100 except that the removable and replaceable panel 218*a*, 218*b* at the back of the main hopper 220 is larger. In the surface cleaning configuration, the dump door 222 is mounted on the removable and replaceable panel 218*a*. In the salter/sander configuration, the sander-salter dispersing mechanism 290 for dispersing the sand and salt from the sand and salt egress 260 onto a surface 201 when the apparatus 200 (namely the sand and salt spreading apparatus 290) is mounted on the removable and replaceable panel 218*b*. Further, the sand and salt transfer apparatus 295 (namely the auger apparatus) is mounted on the removable and replaceable panel 218*b* by means of mounting arms 219. Also, the sander-salter agitator 298 is carried by a removable and replaceable pane 218*b*. This particular configuration makes it relatively quick and easy to change the configuration of the apparatus 200 between seasons.

Reference will now be made to FIGS. 7 through 11, which show a third preferred embodiment of the apparatus according to the present invention, as indicated by the general reference numeral 300. The third preferred embodiment apparatus 300 is similar to the first preferred embodiment apparatus 100 except that the main hopper 320 is configured slightly differently and the water tank 318 is located rearwardly of the main hopper 320. Further, the sander-salter dispersing mechanism 390 for dispersing the sand and salt from the sand and salt egress 360 onto a surface 301 when the main hopper is in the salter-sander configuration is located towards the front of the main hopper 320, not towards the rear of the main hopper 320. The forward positioning of the means 390 for dispersing the sand and salt from the sand and salt egress 360 precludes damage to the means 390 for dispersing the sand and salt from the sand and salt egress 360 in the event that the surface cleaning vehicle 302 backs up into a snow bank, or the like. The means 390 for dispersing the sand and salt from the sand and salt egress 360 onto a surface when the main hopper is in the salter-sander configuration comprises a sand and salt spreading apparatus 390 including a rotatable delivery member 392. Any suitable means 390 for dispersing the sand and salt can be used.

Figure 7:
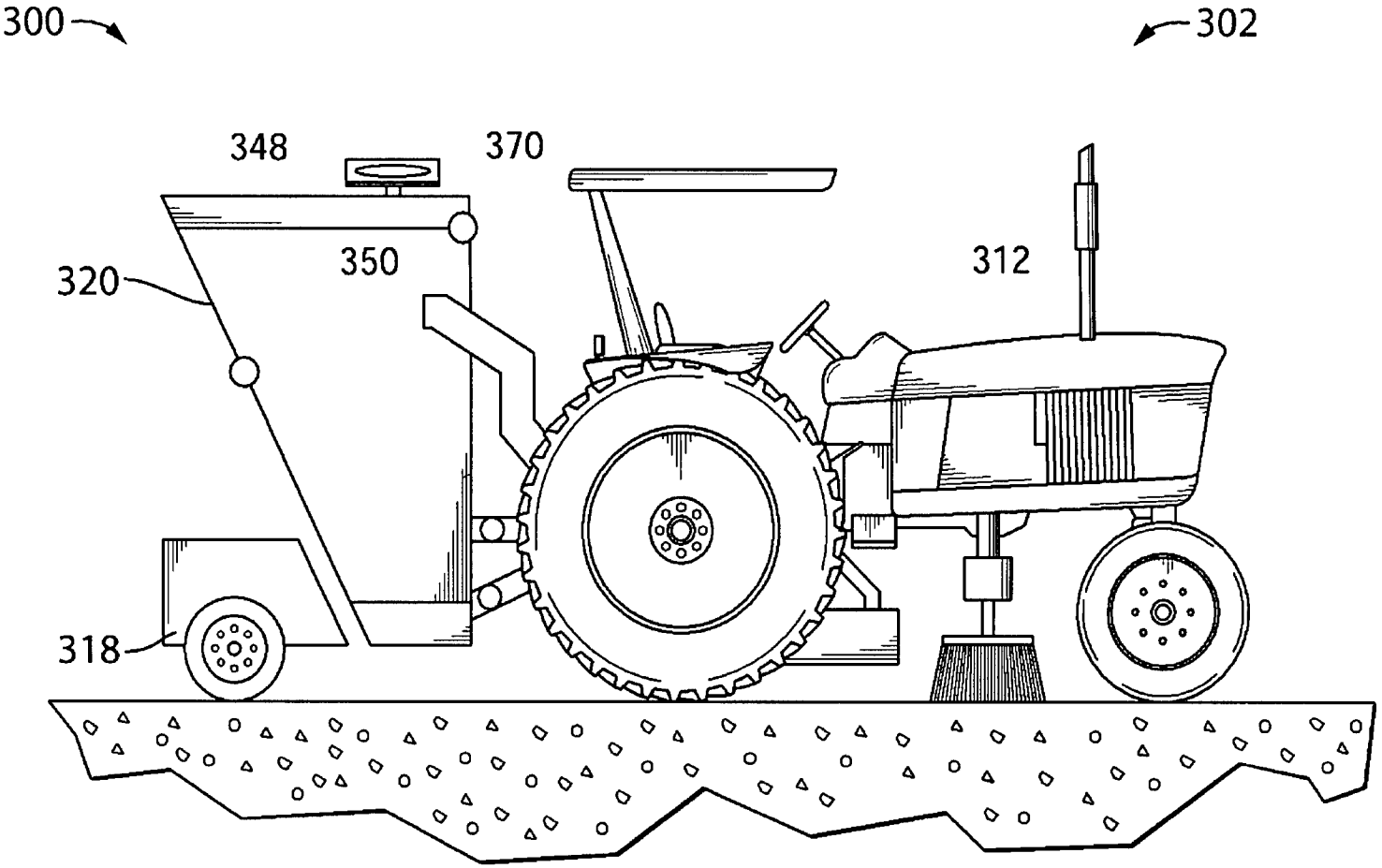
FIG. 7 is side elevational view of the third preferred embodiment of the apparatus according to the present invention, in a surface cleaning configuration.
Figure 8:
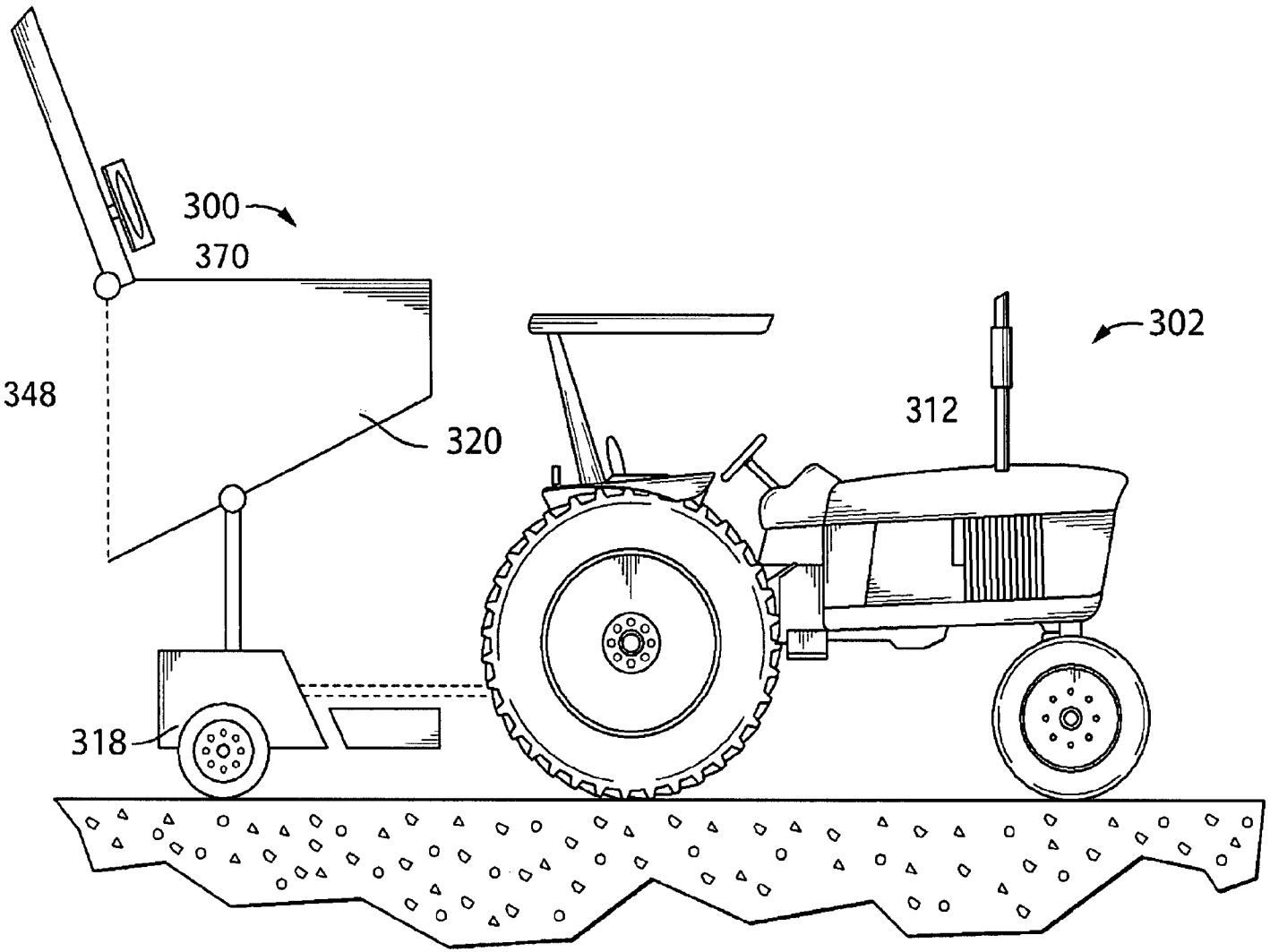
FIG. 8 is a side elevational view of the third preferred embodiment of the apparatus of FIG. 7, in a surface cleaning configuration, with the main hopper in a dumping position.
Figure 9:
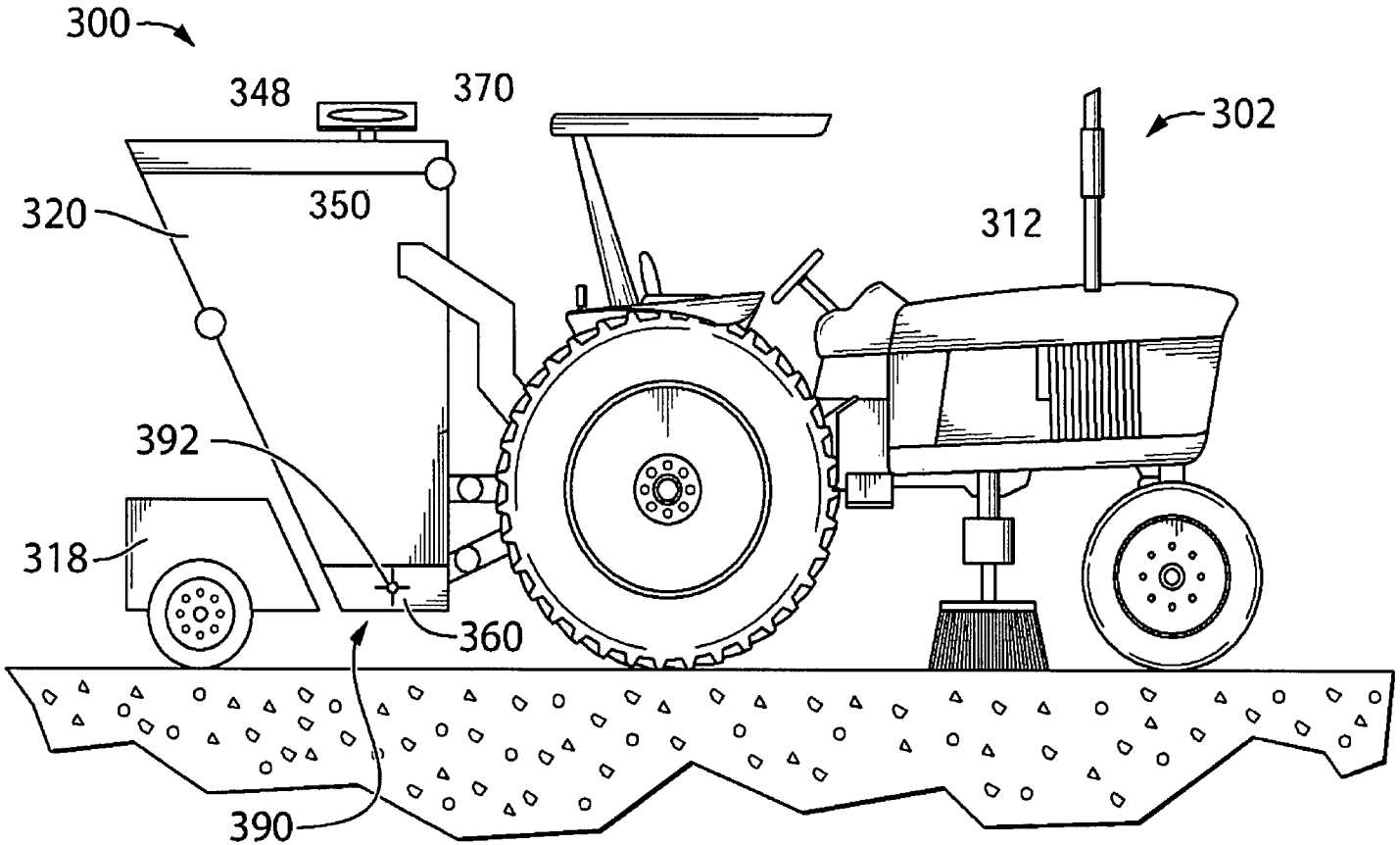
FIG. 9 is a side elevational view of the third preferred embodiment of the apparatus of FIG. 7, but in a salter/sander configuration, with the top dumping door closed.
Figure 10:
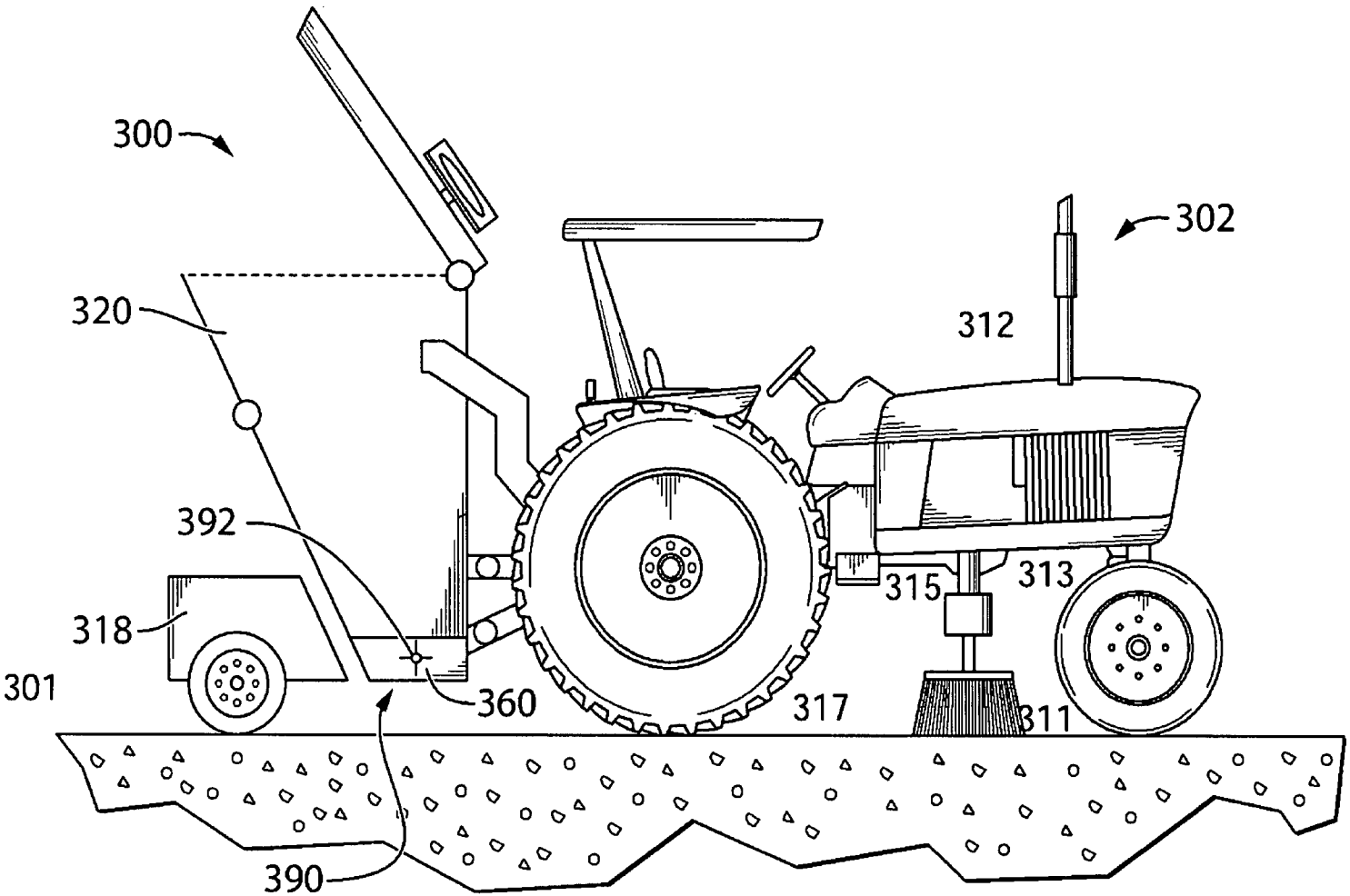
FIG. 10 is a side elevational view of the third preferred embodiment of the apparatus of FIG. 7, but in a salter/sander configuration, with the top dumping door closed.
Figure 11:
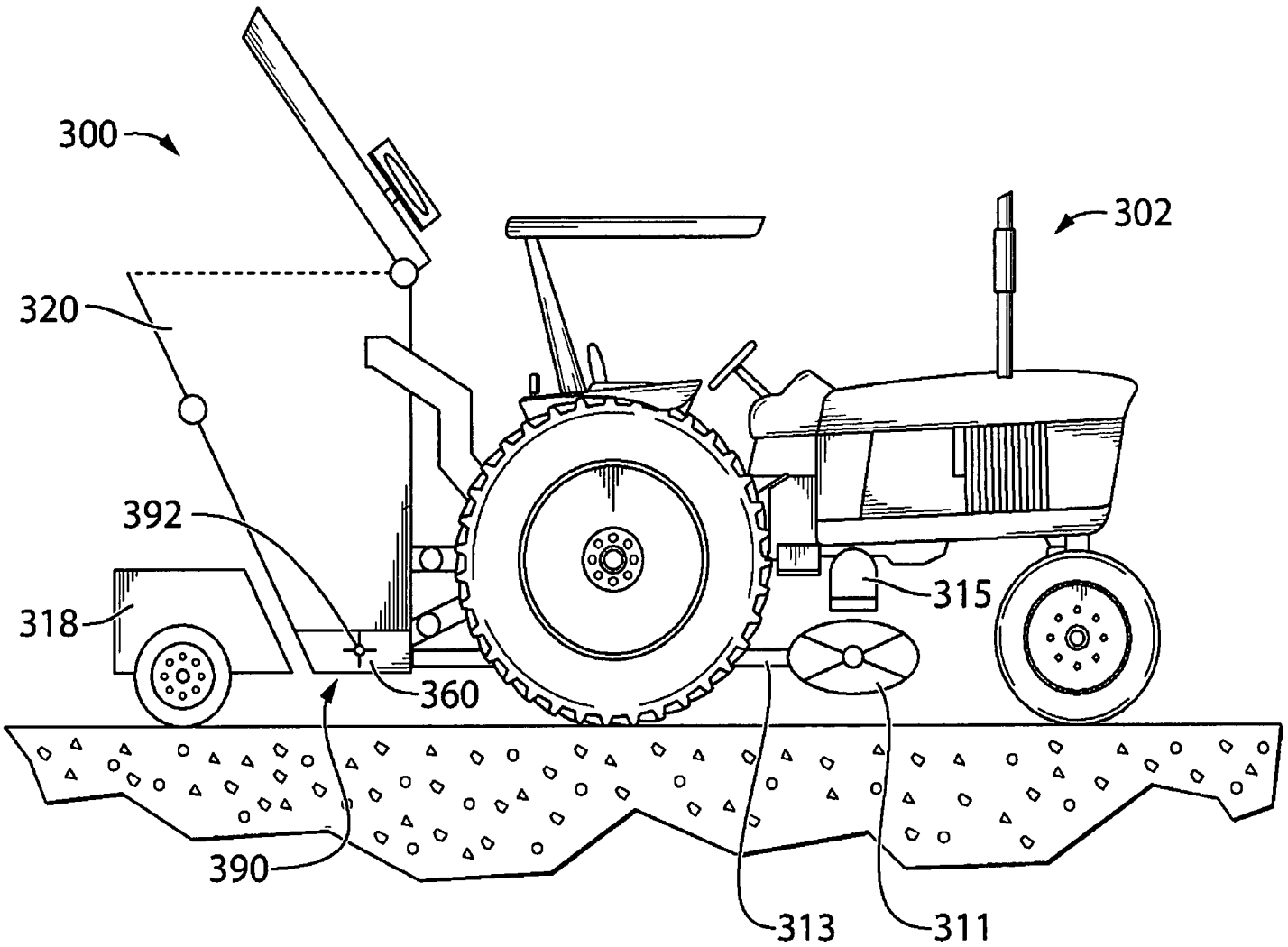
FIG. 11 is a side elevational view of the third preferred embodiment of the apparatus of FIG. 7, but in a salter/sander configuration, with the top dumping door closed, and showing optional rotatable spreader discs disposed between the front and rear wheels of the tractor.

In another aspect, the main hopper 320 is movable between a travel position, as shown in FIG. 7, whereat the debris-laden airflow ingress 350 and the airflow egress 370 are in use, and the debris dumping egress 348 is substantially closed off, and a dumping position, as shown in FIG. 8, whereat the debris dumping egress is openable.

Also, in the third preferred embodiment apparatus 300, the main hopper 320 dumps over and past the water tank 318. As can be readily seen, the overall geometry of the third preferred embodiment apparatus 300 must be such that the main hopper 320 clears the back end of the tractor 312.

Further, in the third preferred embodiment apparatus 300, in the salter/sander configuration, there is an optional pair of rotatable spreader discs 311 (shown in FIG. 11) operatively mounted on the gutter broom arms 313 such that the rotatable spreader discs 311 are selectively rotated by the hydraulic motors 315 that rotate the gutter brooms (not specifically shown) when the apparatus 300 is in its surface cleaning configuration. A forward auger 317 is used to feed sand and salt from the main hopper 320 to the rotatable spreader discs 311.

Reference will now be made to FIGS. 12 through 14, which show a fourth preferred embodiment of the apparatus according to the present invention, as indicated by the general reference numeral 400. The fourth preferred embodiment apparatus 400 is similar to the first preferred embodiment apparatus 100 except that the gutter brooms 411*a*, as shown in FIG. 12, are readily removable and replaceable by the rotatable spreader discs 411*b*, as shown in FIG. 13. The rotatable spreader discs 411*b* are selectively rotated by the hydraulic motors 415 that rotate the gutter brooms 411*a* (FIG. 12) when the apparatus 400 is in its surface cleaning configuration. A forward auger 417 is used to feed sand and salt from the main hopper 420 to the rotatable spreader discs 411*b*. The gutter brooms 411*a*, as shown in FIG. 12, are readily removable and replaceable by a lawn mower deck 411*c*. The blades of the lawn mower deck 411*c* are selectively rotated by the hydraulic drive motors 415 that rotate the gutter brooms 411*a* (FIG. 12) when the apparatus 400 is in its surface cleaning configuration.

In each case, the changeover from one configuration to the other is relatively quick and easy since all of the functioning and mounting parts of the gutter broom arms 413 are kept in place and the hydraulic drive motors 415 that are mounted on the gutter broom arms 413 are kept in place and used.

In an alternative embodiment of the present invention, it is contemplated that the debris receiving ingress and the sand and salt receiving ingress are one common ingress.

As can be understood from the above description and from the accompanying drawings, the present invention provides an apparatus wherein it is not necessary to store the sand and salter spreader apparatus and the open top container during summer months, wherein there is no dumping of the sand and salt such that it misses the open top container, wherein the process of feeding sand and salt from the main hopper to the sand and salt spreading apparatus can be continuous, wherein the process of transferring sand and salt from the main hopper to the sand and salt spreading apparatus does not slow down the overall salting and sanding operation significantly, wherein the process of transferring sand and salt from the main hopper to the sand and salt spreading apparatus does not require the top of the main hopper to be opened, wherein the clumping of salt within the main hopper is substantially precluded, wherein the capital cost of equipment is significantly reduced, wherein the storage of equipment during the off-season is virtually unnecessary, wherein the time needed to be spent mounting and unmounting equipment each season is minimized, an apparatus having a surface cleaning configuration and a sander-salter configuration, wherein the main hopper has substantially the same capacity in both configurations, wherein the main hopper is designed to carry the load of debris in the surface cleaning configuration and to carry the load of sand and/or in the sander-salter configuration, and wherein the main hopper does not dump salt and/or sand to the sand and salt egress, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the pick-up head for a mobile sweeper of the present invention without departing from the spirit and scope of the accompanying claims.

The invention claimed is:

1. An apparatus comprising:

a main hopper having a surface cleaning configuration and a sander-salter configuration;

wherein, in said surface cleaning configuration, said main hopper has a debris-laden airflow ingress, an airflow egress, and a debris dumping egress, and is substantially sealed to the ambient surroundings other than said debris-laden airflow ingress and said airflow egress;

wherein, in said sander-salter configuration, said main hopper has a sander and salt receiving ingress and a sand and salt egress;

wherein, in use, and when said main hopper is in said surface cleaning configuration, substantially all debris-laden air enters said main hopper through said debris-laden airflow ingress, substantially all air exits the main hopper through said airflow egress, and substantially all debris exits the main hopper through said debris dumping egress; and, wherein, in use, and when said main hopper is in said sander-salter configuration, substantially all sand and salt enter the main hopper through said sander and salt receiving ingress, and substantially all sand and salt exit the main hopper through said sand and salt egress.

2. The apparatus of claim 1, wherein, in said sander-salter configuration, said main hopper disperses sand and/or salt directly to the surface being maintained.

3. The apparatus of claim 1, further comprising a sand and salt agitator disposed at said sand and salt egress.

4. The apparatus of claim 3, wherein said sand and salt agitator is disposed within said main hopper.

5. The apparatus of claim 4, wherein said sand and salt agitator is carried by said main hopper.

6. The apparatus of claim 4, wherein said sand and salt agitator is carried by a removable and replaceable panel.

7. The apparatus of claim 1, further comprising a sander-salter dispersing mechanism disposed exteriorly to said main hopper and in sand and salt receiving relation with respect to said sand and salt egress.

8. The apparatus of claim 7, wherein said sander-salter dispersing mechanism is carried by said main hopper.

9. The apparatus of claim 7, wherein said sander-salter dispersing mechanism is carried by a panel mounted in removable and replaceable relation on the back of said main hopper.

10. The apparatus of claim 1, wherein said main hopper is movable between a travel position whereat said debris-laden airflow ingress and said airflow egress air in use and said debris dumping egress is substantially closed off, and a dumping position whereat said debris dumping egress is openable.

11. The apparatus of claim 10, wherein, in said sander-salter configuration, said main hopper directly feeds sand and/or salt to said sand and salt egress on a substantially continuous basis.

12. The apparatus of claim 1, wherein, said main hopper comprises a single unitary main cavity for receiving and retaining debris in said surface cleaning configuration and for retaining sand and salt in said sander-salter configuration, and wherein, in said surface cleaning configuration, said single unitary main cavity directly feeds sand and/or salt to said sand and salt egress on a substantially continuous basis.

13. The apparatus of claim 1, wherein, said main hopper comprises a single unitary main cavity for receiving and retaining debris in said surface cleaning configuration and for retaining sand and salt in said sander-salter configuration, and wherein, in said surface cleaning configuration, said single unitary main cavity is in open relation with respect to said sand and salt egress.

14. The apparatus of claim 1, further comprising a sander-salter transfer apparatus disposed within said main hopper for transferring sand and/or salt within said main hopper to said sand and salt egress.

15. The apparatus of claim 14, wherein said sander-salter transfer apparatus comprises an auger.

16. The apparatus of claim 14, wherein said sander-salter transfer apparatus is removable and replaceable.

17. The apparatus of claim 14, further comprising a transfer apparatus cover mountable in said main hopper in protecting relation over said sander-salter transfer apparatus.

18. The apparatus of claim 14, further comprising a main fan having an air inlet and an air outlet, and a debris pick-up head having an air inlet and an air outlet, and wherein said air inlet of said main fan is connected in sealed relation to said airflow egress of said main hopper, said air outlet of said main fan is connected in sealed relation to said air inlet of said pick-up head, and said air outlet of said pick-up head is connected in sealed relation to said debris-laden airflow ingress of said main hopper.

19. The apparatus of claim 14, further comprising a plurality of wheels mounted in weight bearing relation on said main hopper.

20. The apparatus of claim 1, wherein said main hopper has a rearwardly slanted floor portion that leads to said salt and said egress and its lower end.

21. The apparatus of claim 1, wherein said sander and salt receiving ingress comprises a top opening in said main hopper.

22. The apparatus of claim 1, wherein the volumetric capacity of said main hopper is substantially constant in either of said surface cleaning configuration and said sander-salter configuration.

23. A surface cleaning vehicle comprising:

a main vehicle;

a main hopper connected to said main vehicle;

a main fan having an air inlet and an air outlet;

a debris pick-up head having an air inlet and an air outlet;

wherein said air inlet of said main fan is connected in sealed relation to said airflow egress of said main hopper, said air outlet of said main fan is connected in sealed relation to said air inlet of said pick-up head, and said air outlet of said pick-up head is connected in sealed relation to said debris-laden airflow ingress of said main hopper;

wherein said main hopper has a surface cleaning configuration and a sander-salter configuration;

wherein, in said surface cleaning configuration, said main hopper has a debris-laden airflow ingress, an airflow egress, and a debris dumping egress, and is substantially sealed to the ambient surroundings other than said debris-laden airflow ingress and said airflow egress; and, wherein, in said sander-salter configuration, said main hopper has a sander and salt receiving ingress and a sand and salt egress;

wherein, in use, and when said main hopper is in said surface cleaning configuration, substantially all debris-laden air enters the main hopper through said debris-laden airflow ingress, substantially all air exits the main hopper through said airflow egress, and substantially all debris exits the main hopper through said debris dumping egress; and, wherein, in use, and when said main hopper is in said sander-salter configuration, substantially all sand and salt enter the main hopper through said sander and salt receiving ingress, and substantially all sand and salt exit the main hopper through said sand and salt egress.

24. The apparatus of claim 23, wherein said main hopper is connected in trailing relation to said main vehicle.

25. The apparatus of claim 24, wherein said main vehicle comprises a tractor and said main hopper is connected in trailing relation to said tractor.

26. A sander salter vehicle comprising:

a main vehicle;

a sander-salter dispersing mechanism connected in trailing relation to said main vehicle;

a main hopper connected to said main vehicle;

a main fan having an air inlet and an air outlet;

a debris pick-up head having an air inlet and an air outlet;

wherein said air inlet of said main fan is connected in sealed relation to said airflow egress of said main hopper, said air outlet of said main fan is connected in sealed relation to said air inlet of said pick-up head, and said air outlet of said pick-up head is connected in sealed relation to said debris-laden airflow ingress of said main hopper;

wherein said main hopper has a surface cleaning configuration and a sander-salter configuration;

wherein, in said surface cleaning configuration, said main hopper has a debris-laden airflow ingress, an airflow egress, and a debris dumping egress, and is substantially sealed to the ambient surroundings other than said debris-laden airflow ingress and said airflow egress; and, wherein, in said sander-salter configuration, said main hopper has a sander and salt receiving ingress and a sand and salt egress;

wherein said sander-salter dispersing mechanism disposed exteriorly to said main hopper and in sand and salt receiving relation with respect to said sand and salt egress;

wherein, in use, and when said main hopper is in said surface cleaning configuration, substantially all debris-laden air enters the main hopper through said debris-laden airflow ingress, substantially all air exits the main hopper through said airflow egress, and substantially all debris exits the main hopper through said debris dumping egress; and, wherein, in use, and when said main hopper is in said sander-salter configuration, substantially all sand and salt enter the main hopper through said sander and salt receiving ingress, and substantially all sand and salt exit the main hopper through said sand and salt egress.

27. The apparatus of claim 26, wherein said main hopper is connected in trailing relation to said tractor.

28. The apparatus of claim 27, wherein said main vehicle comprises a tractor and said main hopper is connected in trailing relation to said tractor.

* * * * *